US010559909B1

(12) United States Patent
Bhosale

(10) Patent No.: US 10,559,909 B1
(45) Date of Patent: Feb. 11, 2020

(54) TAMPER RESISTANT ELECTRICAL RECEPTACLE

(71) Applicant: LEVITON MANUFACTURING CO., INC., Melville, NY (US)

(72) Inventor: Vikramsinh P. Bhosale, Westbury, NY (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 0 days.

(21) Appl. No.: 16/291,291

(22) Filed: Mar. 4, 2019

(51) Int. Cl.
*H01R 13/453* (2006.01)

(52) U.S. Cl.
CPC ..... *H01R 13/453* (2013.01)

(58) Field of Classification Search
CPC ..... H01R 13/447; H01R 13/453; H01R 13/4534; H01R 13/4536; H01R 13/4538; Y10S 439/911
USPC ..... 439/135–137
See application file for complete search history.

(56) References Cited

U.S. PATENT DOCUMENTS 4,867,694 A * 9/1989 Short ..... H01R 13/4534 439/137
5,702,259 A 12/1997 Lee
5,919,060 A 7/1999 Lee
6,086,391 A * 7/2000 Chiu ..... H01R 13/4534 439/145
6,217,353 B1 * 4/2001 Yu-Tse ..... H01R 13/4534 174/67
7,214,101 B1 5/2007 Tong
7,355,117 B2 4/2008 Castaldo et al.
7,551,047 B2 6/2009 Sokolow et al.
7,588,447 B1 * 9/2009 Ni ..... H01R 13/4534 439/137
7,753,700 B2 7/2010 Ma
7,820,909 B2 10/2010 Castaldo et al.
7,868,719 B2 1/2011 Bazayev et al.
8,242,362 B2 8/2012 Castaldo et al.
8,753,149 B2 6/2014 Lee
9,450,325 B1 * 9/2016 Lai ..... H01R 13/4534
10,063,003 B2 8/2018 Bhosale et al.
(Continued)

OTHER PUBLICATIONS

Bticino Philippines, Inc., General Catalogue, Bamboo Devices, 2014, 2015.

*Primary Examiner* — Oscar C Jimenez
(74) *Attorney, Agent, or Firm* — Carter, DeLuca & Farrell LLP

(57) ABSTRACT

A tamper resistant electrical receptacle is disclosed that includes a cover having two cover apertures, a platform, a slider positioned between the cover and the platform and coupled to the platform, and a coil spring. The platform includes two platform apertures aligned with the two cover apertures, a channel between the two platform apertures, and a pin trap channel separate from the two platform apertures for trapping a pin inserted into one of the two cover apertures. The slider includes a post that engages the channel, and shutters connected to the post. The coil spring is coupled to the slider and has a resting state in which the shutters are interposed between the cover and platform apertures, and a compressed state in which the shutters are not interposed. The slider glides along the channel of the platform as the coil spring moves between the resting and compressed states.

14 Claims, 12 Drawing Sheets

(56) References Cited

U.S. PATENT DOCUMENTS

| | | | | |
|---|---|---|---|---|
| 2012/0083143 | A1* | 4/2012 | Jiang | H01R 13/4534 439/137 |
| 2013/0109207 | A1* | 5/2013 | Bhosale | H01R 13/4534 439/137 |
| 2014/0134860 | A1* | 5/2014 | Lo | H01R 13/4534 439/140 |
| 2016/0104963 | A1* | 4/2016 | Savicki, Jr. | H01R 25/006 439/138 |
| 2017/0279214 | A1* | 9/2017 | Lee | H01R 13/4534 |

* cited by examiner

TAMPER RESISTANT ELECTRICAL RECEPTACLE

TECHNICAL FIELD

The present disclosure relates to electrical receptacles, and more particularly, to tamper resistant tamper receptacles.

BACKGROUND

Household appliances are typically connected to electrical receptacles having at least a hot terminal and neutral terminal, and the terminals are usually implemented as receptacles to which an electrical plug of the household appliance is attached.

In an effort to limit the exposure of children to electrical shock, the National Electrical Code (NEC) requires that in buildings where the predominant function of such buildings is to provide shelter for children (e.g., schools, nurseries, daycare facilities, hospitals, residential housing), tamper-resistant electrical receptacles should be designed within an electrical distribution system throughout such buildings. In particular, since a large percentage of electrical receptacles used in buildings are installed near the floor, a young child or infant can insert small elongated articles into the cover apertures of the electrical receptacle. More particularly, if the child inserts an object made of conductive material, such as a metal article, electrical shock may result.

Commonly owned U.S. Pat. Nos. 7,868,719 and 10,063,003, which are hereby incorporated herein by reference in their entirety, describe tamper resistant electrical receptacles. While those electrical receptacles are advantageous for many applications, they may not be able to accommodate many of the plug and receptacle configurations around the world. Therefore, there is continuing interest in developing and improving tamper resistant electrical receptacles.

SUMMARY

The present disclosure relates to tamper resistant electrical receptacles. One aspect of the present disclosure is directed to tamper resistant electrical receptacles that can provide tamper resistance for many different plug and receptacle configurations around the world.

In accordance with one aspect of the present disclosure, an electrical receptacle includes a cover including two cover apertures configured to receive two contact blades of a plug, a platform coupled to the cover where the platform includes two platform apertures aligned with the two cover apertures and a channel between the two platform apertures and a pin trap channel separate from the two platform apertures, a slider positioned between the cover and the platform and coupled to the platform where the slider includes a post engaging the channel and shutters connected to the post, and a coil spring coupled to the slider. The coil spring has a resting state in which the shutters are interposed between the two cover apertures and the two platform apertures, and has a compressed state in which the shutters are not interposed between the two cover apertures and the two platform apertures such that the two contact blades of the plug are permitted to pass through the two platform apertures. The slider glides along the channel of the platform as the coil spring moves between the resting and compressed states. The pin trap channel is positioned to trap a pin that is inserted into one of the two cover apertures and that reaches the platform past the shutters.

In various embodiments, the two platform apertures are oriented horizontally relative to each other, and the channel of the platform is oriented vertically such that the slider and the shutters glide vertically along the channel.

In various embodiments, the shutters are angled relative to the platform such that the shutters tilt horizontally about the post.

In various embodiments, the cover and the platform each includes a locking mechanism, and the shutters engage both locking mechanisms and are diagonally locked to the cover and the platform when the shutters are fully left-tilted and when the shutters are fully right-tilted.

In various embodiments, at least one of the cover or the platform includes a left-tilt locking mechanism and at least one of the cover or the platform includes a right-tilt locking mechanism, and the shutters engage the left-tilt locking mechanism when the shutters are fully left-tilted, and engage the right-tilt locking mechanism when the shutters are fully right-tilted.

In various embodiments, the slider includes protrusions, and the left-tilt locking mechanism and the right-tilt locking mechanisms are complementary protrusions configured to engage the protrusions of the slider.

In various embodiments, the shutters do not engage the left-tilt locking mechanism or the right-tilt locking mechanism when a tilt of the shutters is less than a predetermined tilt threshold.

In various embodiments, the shutters are contoured to maintain the tilt of the shutters at less than the predetermined tilt threshold for different orientations of the contact blades of the plug. In various embodiments, the shutters are contoured to maintain the tilt of the shutters at less than the predetermined tilt threshold for at least two of: plug type A, plug type B, plug type C, plug type D, plug type E, plug type F, plug type G, plug type H, plug type I, plug type J, plug type K, plug type M, or plug type N.

In various embodiments, the shutters of the slider are sloped towards the pin trap.

In various embodiments, the shutters are sloped toward the platform in a direction of the coil spring extending from the compressed state to the resting state.

In various embodiments, forcing the contact blades of the plug against the shutters causes the slider to glide along the channel and compress the coil spring from the resting state to the compressed state.

In various embodiments, the cover further includes a second channel between the two cover receptacles, and the slider further includes a second post configured to engage the second channel, where the second channel is parallel to the channel of the platform.

In various embodiments, the platform further includes a ledge, where the coil spring in the resting state biases the slider against the ledge.

Further details and aspects of exemplary embodiments of the present disclosure are described in more detail below with reference to the appended figures.

DETAILED DESCRIPTION

The present disclosure relates to tamper resistant electrical receptacles. One aspect of the present disclosure is directed to tamper resistant electrical receptacles that can provide tamper resistance for many different plug and receptacle configurations around the world.

Figure 1:
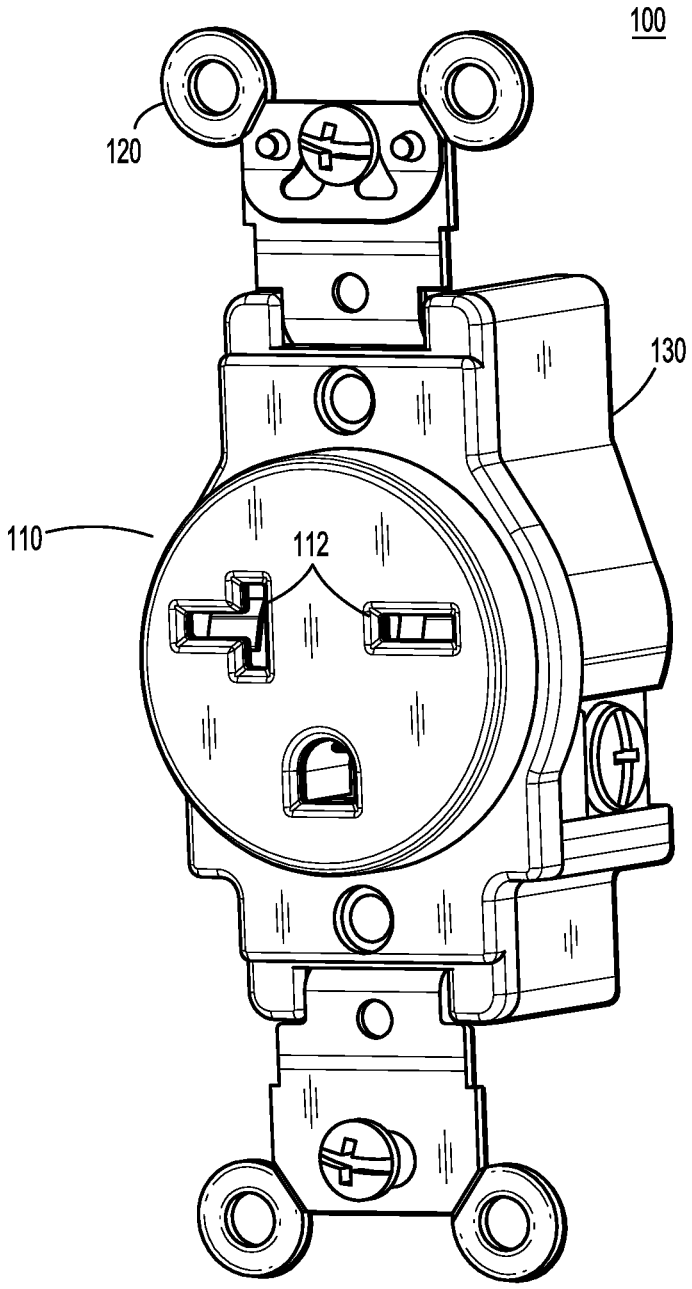
FIG. 1 is a diagram of an exemplary electrical receptacle, in accordance with aspects of the present disclosure.

FIG. 1 is a diagram of an exemplary electrical receptacle in accordance with aspects of the present disclosure. The illustrated receptacle 100 includes a cover 110, a mounting strap 120 used to fasten the receptacle to a junction box, and a housing 130. Various components under the cover 110 will be described later herein. The cover 110 includes cover apertures 112 for receiving contact blades of a plug. The illustrated cover 110 and cover apertures 112 are exemplary, and the present disclosure applies to other types of covers and cover apertures as well. For example, the present disclosure can be applied to 110 V, 125V, 220 V, or 250 V receptacles, and/or can apply to one or more of plug type A, plug type B, plug type C, plug type D, plug type E, plug type F, plug type G, plug type H, plug type I, plug type J, plug type K, plug type M, and/or plug type N receptacles. Additionally, although the receptacle of FIG. 1 includes a single outlet, the present disclosure can be applied to receptacles having multiple outlets.

Figure 2:
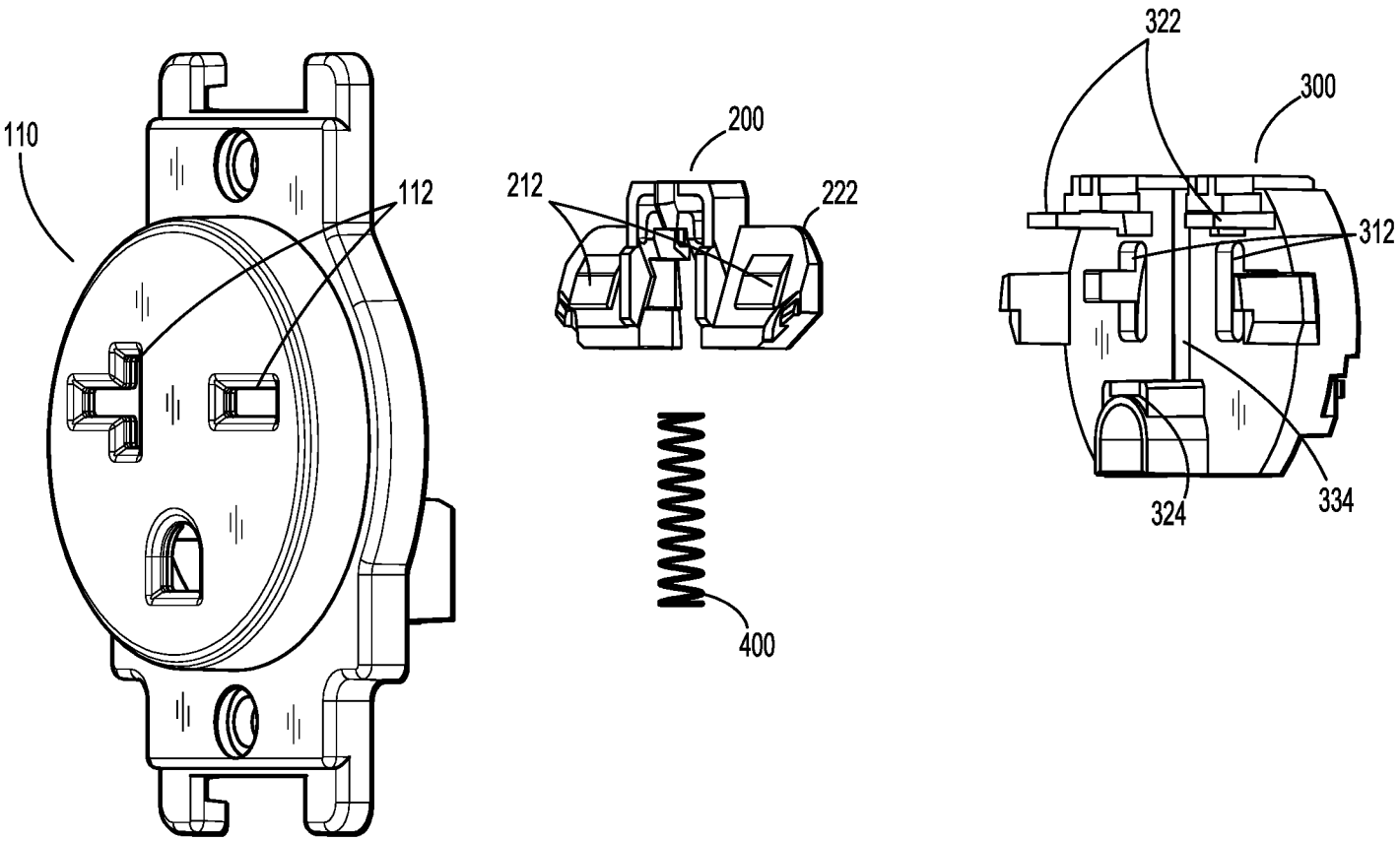
FIG. 2 is a diagram of exemplary components of the electrical receptacle of FIG. 1, in accordance with aspects of the present disclosure.
Figure 3:
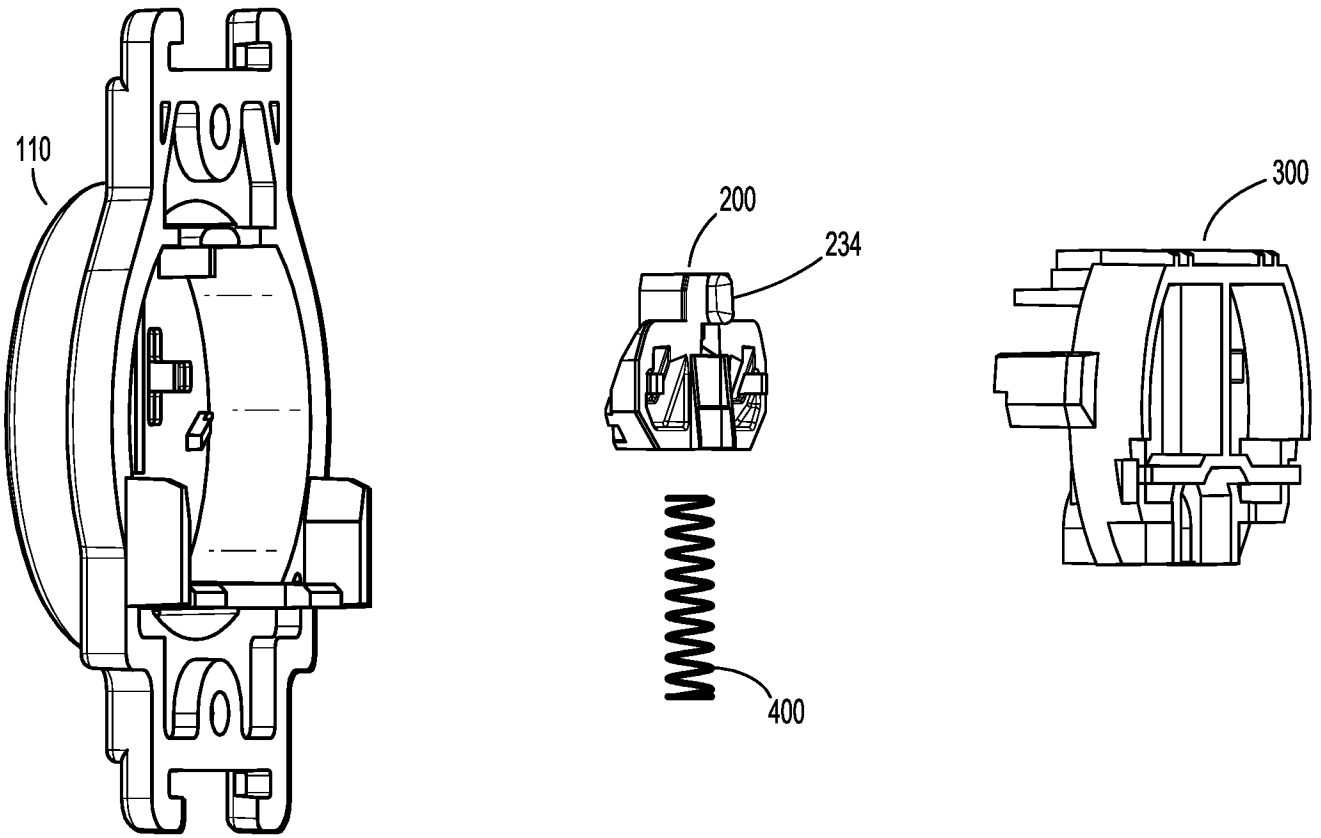
FIG. 3 is another diagram of the components of FIG. 2, in accordance with aspects of the present disclosure.

FIG. 2 is a diagram of exemplary components of the electrical receptacle of FIG. 1, including the cover 110, a slider 200, a platform 300, and a coil spring 400. FIG. 3 is a diagram of the components from another perspective. The slider 200, the platform 300, and the coil spring 400 cooperate in a particular way to provide tamper resistance, which will be described in more detail later herein. FIG. 2 illustrates the front or outward-facing sides of the various components, and FIG. 3 illustrates the back or inward-facing sides of the components. As used herein, the terms "front" and "outward" refer to the direction towards the user of the receptacle, and the terms "back" and "inward" refer to the direction towards the wiring of the receptacle.

The platform 300 includes platform apertures 312. The platform apertures 312 align with the cover apertures 112. In various embodiments, the platform apertures 312 may accommodate multiple types of plugs and, therefore, may not have the same shape as the cover apertures 112.

The slider 200 couples with the spring 400, and the combined assembly fits onto the platform 300. In particular, a shoulder portion 222 of the slider abuts a top ledge 322 of the platform, and the bottom of the spring 400 abuts a bottom ledge 324 of the platform. In this configuration, which will be referred to as the "resting state," the coil spring 400 biases the slider 200 against the top ledge 322. The slider 200 includes shutters 212. In the resting state, the shutters 212 are interposed between the cover apertures 112 and the platform apertures 312. Therefore, in the resting state, the shutters 212 provide tamper resistance by blocking implements that may be inserted into the cover apertures 112, and blocks such implements from reaching the platform receptacles 312. Other tamper resistance characteristics of the slider 200 will be described in more detail later herein.

The platform 300 includes a channel 334 positioned between the platform apertures 312. The coil spring 400 can be positioned in a portion of the channel 334, and the slider 200 also engages a portion of the channel 334. The slider 200 engages the channel 334 by a post 234 (FIG. 3), which slides along the channel 334. The channel 334 serves to guide the movement of the slider 200. When the slider 200 moves downward along the channel 334, the shutters 212 move out of the path between the cover apertures 112 and the platform apertures 312, and the coil spring 400 becomes compressed. When the shutters 212 are no longer interposed between the cover apertures 112 and platform apertures 312, the coil spring 400 is compressed and such a configuration will be referred to herein as a "compressed state." The slider 200 moves along the channel 334 between the resting and compressed states, thereby providing tamper resistance or providing access to the platform apertures, respectively.

The illustrated components and configurations of FIG. 2 and FIG. 3 are exemplary, and variations are contemplated to be within the scope of the present disclosure. For example, the various components can have different shapes than those illustrated. The coil spring, the slider, the resting state, and the compressed state can be configured differently, such as being inverted from the configuration disclosed herein. In various embodiments, the coil spring can be replaced by another type of biasing element, such as a rubber band that has a resting state and a stretched state. Additionally, variations can be made to apply the various components to different types of plugs. In various embodiments, the various components need not be separate and can be combined in various ways. For example, in various embodiments, the slider 200 and the coil spring 400 can be integrated into one component. In various embodiments, the slider 200 and the platform 300 can be coupled together as one component.

Figure 4:
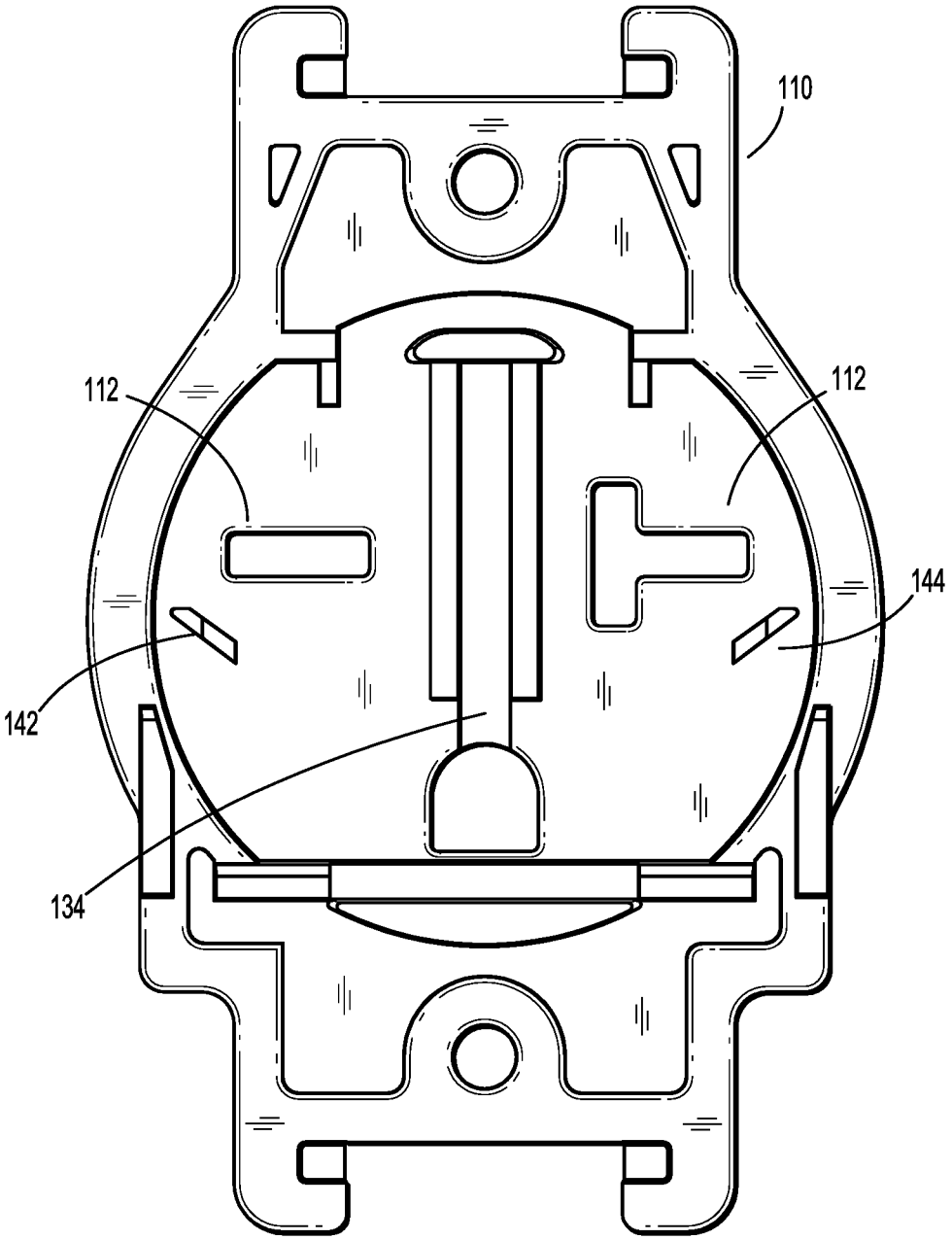
FIG. 4 is a diagram of an exemplary cover component, in accordance with aspects of the present disclosure.

FIG. 4 is a diagram of the back or inward-facing side of a cover in accordance with aspects of the present disclosure. As disclosed above herein, the cover 110 includes cover apertures 112. In the illustrated embodiment, the cover 110 includes a channel 134 between the cover apertures 112. The channel 134 can operate in the same manner as the channel 334 of the platform 300. In particular, the channel 134 of the cover 110 can operate to guide the slider 200 and the coil spring 400 between the resting state and the compressed state. In the illustrated embodiment, the cover apertures 112 are oriented horizontally with respect to each other, and the channel 134 is oriented vertically. In various embodiments, the cover 110 may not include a channel. The illustrated cover also includes locking mechanisms 142, 144, which operate to immobilize the slider 200 in the resting state to provide tamper resistance, as will be described in more detail later herein. In various embodiments, a cover may include a different type of locking mechanism or may not include any locking mechanisms.

Figure 5:
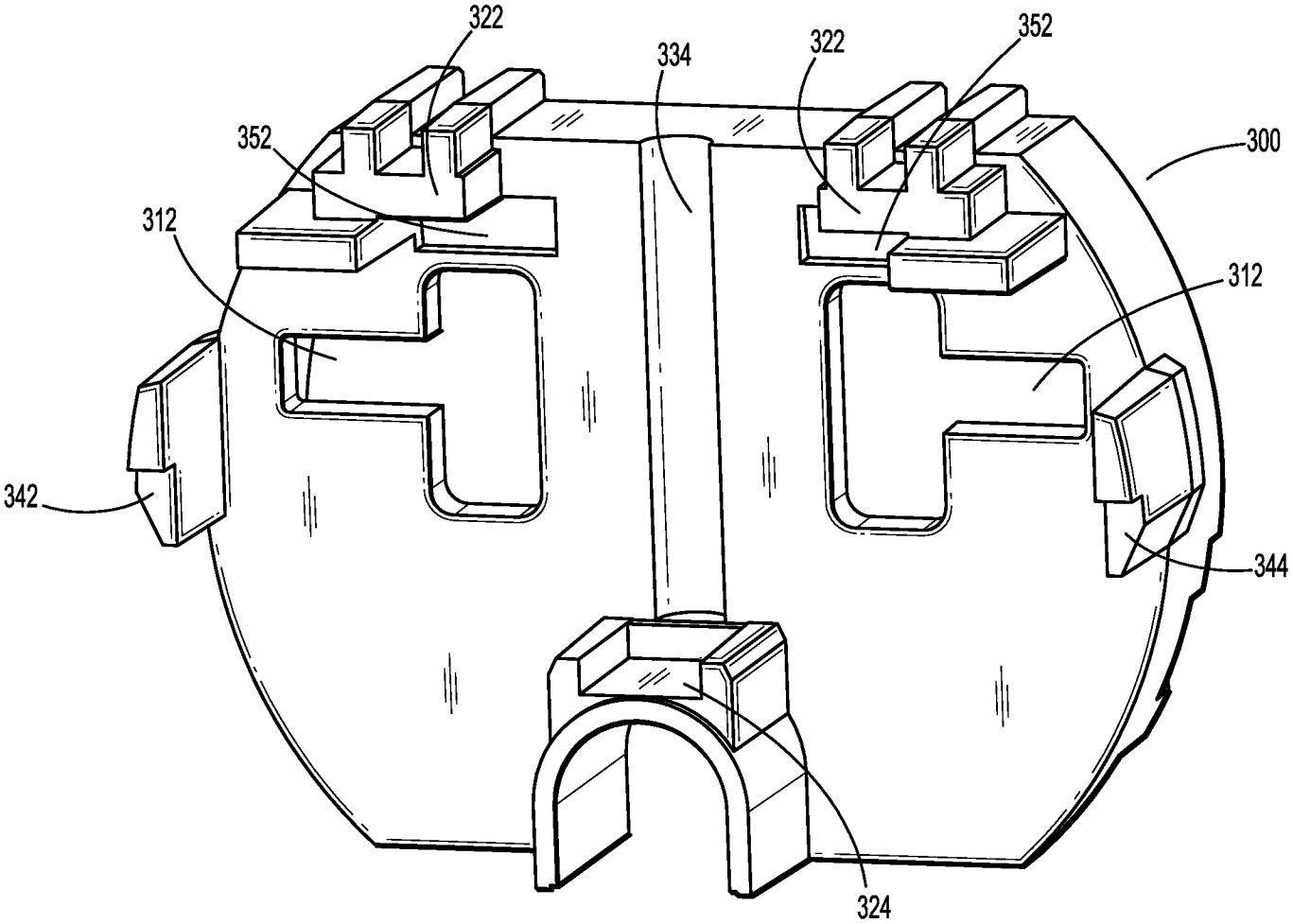
FIG. 5 is a diagram of an exemplary platform component, in accordance with aspects of the present disclosure.

FIG. 5 is a diagram of the front or outward-facing side of a platform in accordance with aspects of the present disclosure. As described above herein, the platform 300 includes platform apertures 312, which are aligned with the cover apertures 112 but which may have a different shape than the cover apertures 112 to accommodate different types of plugs. The platform 300 also includes ledges 322, 324 that abut the slider and spring assembly, and a channel 334 that guides movement of the slider and spring assembly. In the illustrated embodiment, the platform apertures 312 are oriented horizontally with respect to each other, and the channel 334 is oriented vertically. The illustrated platform 300 also includes locking mechanisms 342, 344, which operate to immobilize the slider 200 in the resting state to provide tamper resistance, as will be described in more detail later herein. In various embodiments, a platform may include different locking mechanism or may not include any locking mechanisms. Also, the illustrated platform 300 pin trap channels 352, which are separate from the platform apertures 312 and operate to catch small implements that may be inserted into the cover apertures 112 and past the slide shutters 212. The pin trap channels 352 will be described in more detail in connection with FIG. 13. In various embodiments, a platform may not include any pin trap channels.

Figure 6:
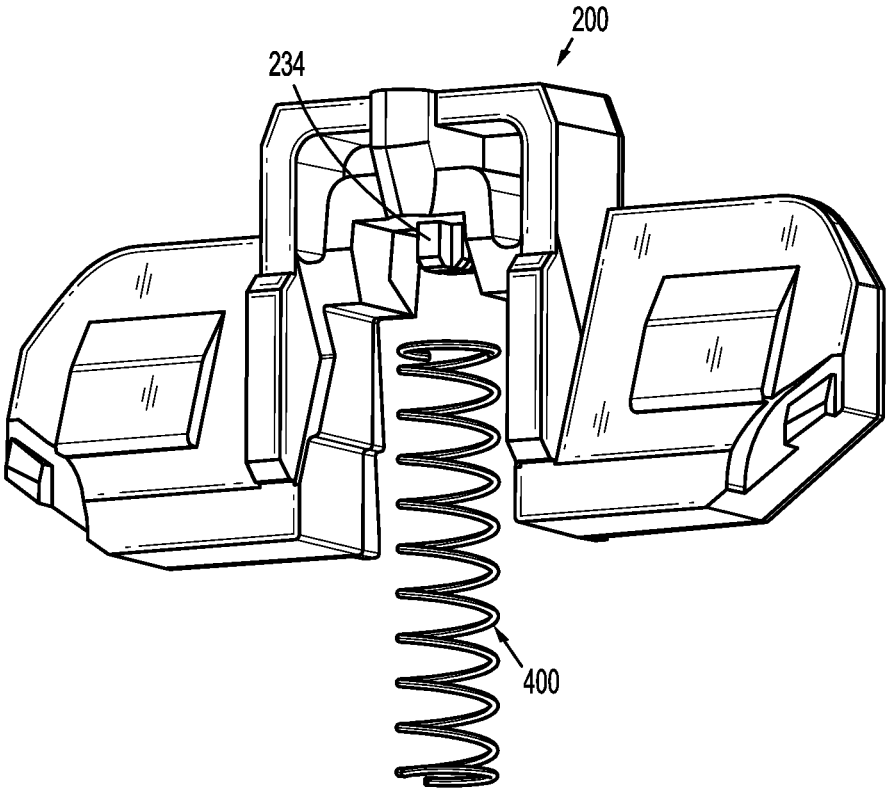
FIG. 6 is a diagram of exemplary slider and spring components, in accordance with aspects of the present disclosure.

FIG. 6 is a diagram of a front or outward-facing side of a slider and spring assembly in accordance with aspects of the present disclosure. In the illustrated embodiment, the slider 200 includes a post 234 that engages the coil spring 400 and couples the slider 200 to the coil spring 400.

Figure 7:
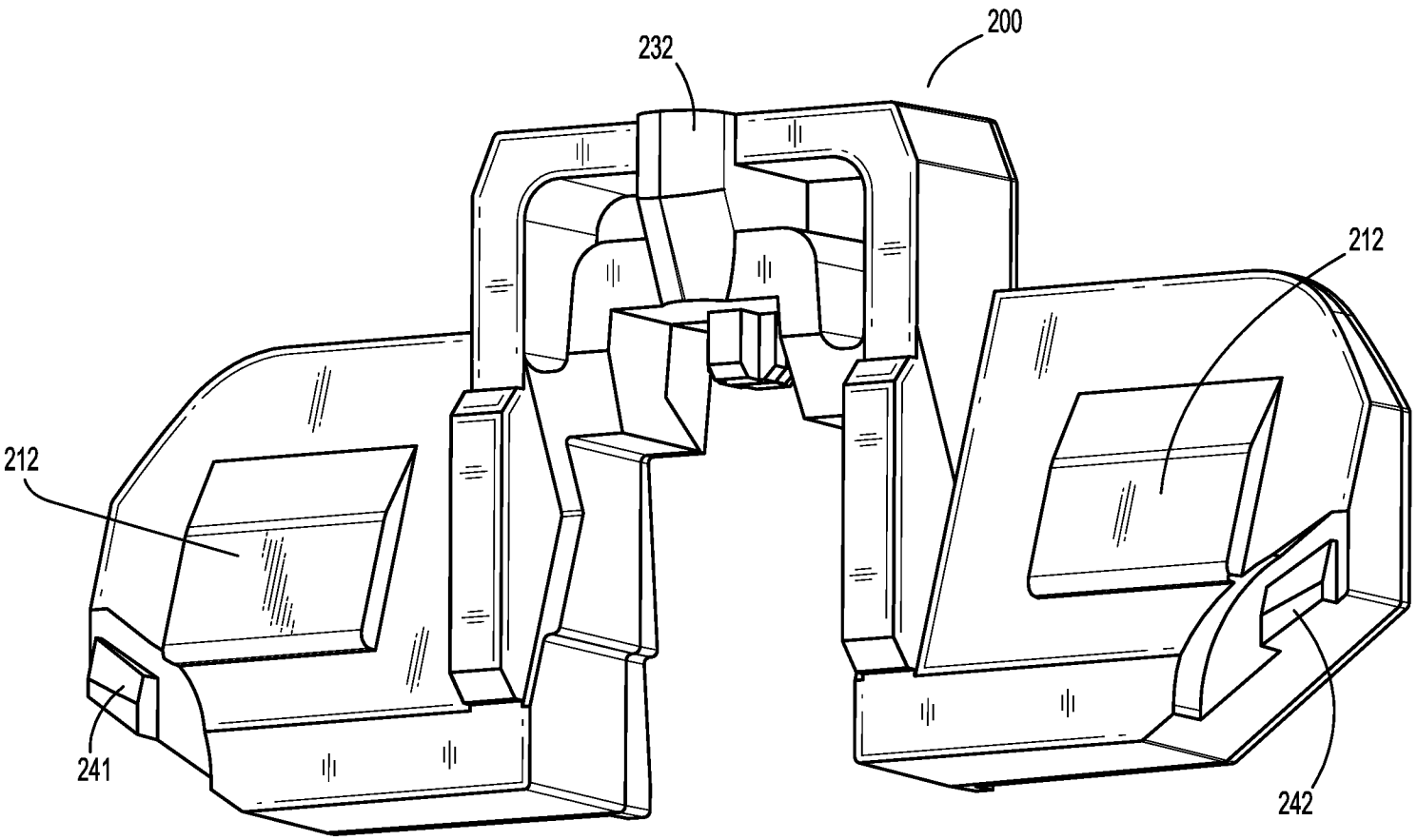
FIG. 7 is a diagram of a perspective view of the front of the slider component, in accordance with aspects of the present disclosure.

FIG. 7 is a larger view of the front side of the slider 200 of FIG. 6. As described above herein, the slider 200 includes shutters 212. As shown in FIG. 7, the shutters 212 are sloped. If the platform includes a pin trap channel, the shutters 212 can be sloped towards the pin trap channel. Additionally, with reference to the resting state and compressed state described earlier herein, the shutters 212 are sloped towards the platform 300 in the direction of the slider 200 moving from the compressed state to the resting state. In this manner, when the contact blades of a plug are urged against the shutters 212, the contact blades progress down the slope of the shutters 212 and urge the slider and spring assembly from the resting state to the compressed state. In accordance with aspects of the present disclosure, the shutters 212 can have a shape or contour that accommodates multiple types of plugs and contact prongs, to permit multiple types of contact prongs to urge the slider and spring assembly from the resting state to the compressed state.

The illustrated front side of the slider 200 also includes a locking mechanism 241, 242, which operate to immobilize the slider 200 in the resting state to provide tamper resistance, as will be described in more detail later herein. In various embodiments, the front side of the slider may include different locking mechanism or may not include any locking mechanisms. Additionally, the illustrated front side of the slider 200 includes a post 232 that is configured to engage a channel 134 (FIG. 4) of the cover, if the cover includes such a channel. The post 232 operates in the same manner as the post 234 described above herein, to guide the movement of the slider 200.

Figure 8:
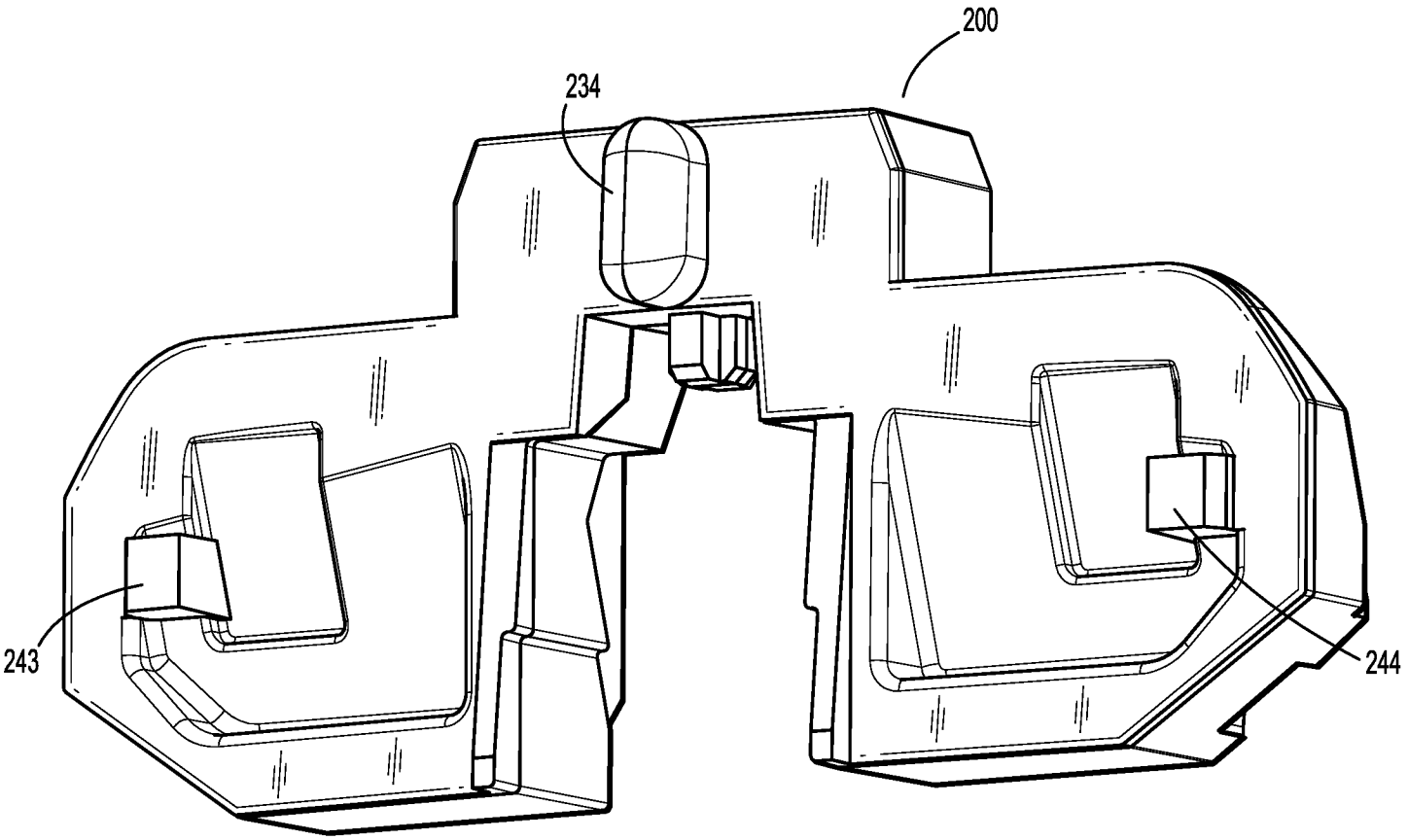
FIG. 8 is a diagram of a perspective view of the back of the slider component, in accordance with aspects of the present disclosure.

FIG. 8 is a diagram of a back or inward-facing side of the slider, in accordance with aspects of the present disclosure. As described above herein, the slider 200 includes a post 234 that engages the channel 334 of the platform and guides the movement of the slider 200 along the channel 334. In the illustrated embodiment, the back side of the slider 200 also includes locking mechanisms 243, 244, which operate to immobile the slider 200 in the resting state and provide tamper resistance, as will be described in more detail later herein. In various embodiments, the back side of the slider 200 may include different types of locking mechanisms or may not include any locking mechanisms.

Figure 9:
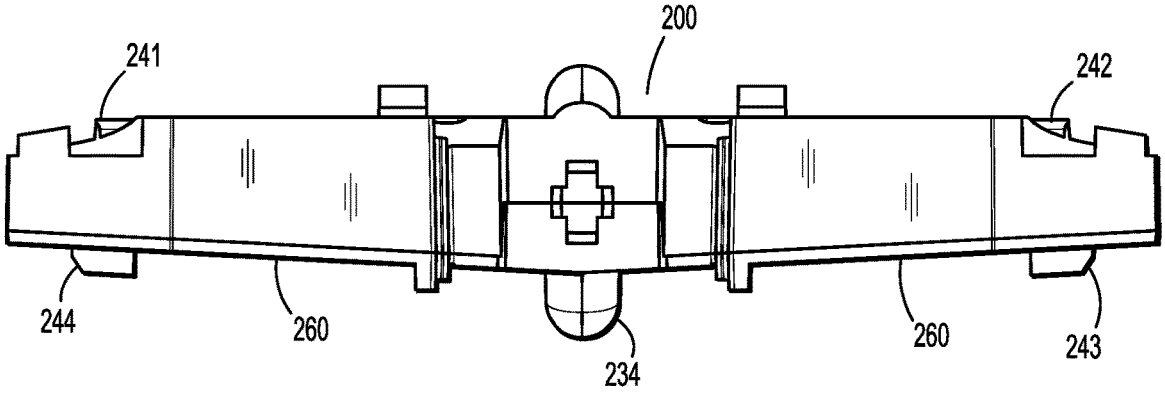
FIG. 9 is a diagram of a bottom view of the slider component, in accordance with aspects of the present disclosure.
Figure 10:
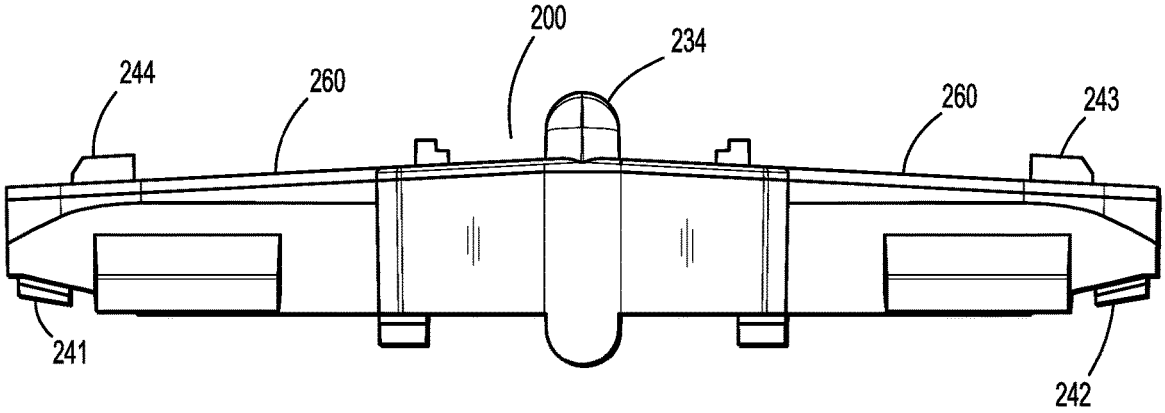
FIG. 10 is a diagram of a top view of the slider component, in accordance with aspects of the present disclosure.

FIG. 9 is a diagram of a bottom view of a slider and FIG. 10 is a diagram of a top view of the slider, in accordance with aspects of the present disclosure. The post 234 at the back side 260 of the slider engages the channel 334 of the platform. The locking mechanisms 241-244 are protrusions that are configured to engage complementary protrusions of the cover and/or the platform. In accordance with an aspect of the present disclosure, the back side 260 of the slider 200 is angled relative to the platform 300. When the back side 260 is angled, as illustrated, the slider 200 tilts horizontally about the post 234. When the slider is fully tilted to the left, the protrusion 244 engages the platform while the protrusion 242 engages the cover. When the slider is fully tilted to the right, the protrusion 243 engages the platform while the protrusion 241 engages the cover. In this manner, the slider 200 can be diagonally locked to the cover 110 and the platform 300 when it is fully tilted to the left or fully tilted to the right. Because a full tilt occurs when an unintended implement is inserted into a cover aperture, such as by a child, the diagonal lock operates to lock the slider and shutters in the resting state and to prevent access to the platform apertures. In various embodiments, the locking mechanisms of the slider 200 and the complementary locking mechanisms of the cover 110 and/or the platform 300 may be different than those illustrated. In various embodiments, the slider may only have locking mechanisms on a front side or on a back side. Other variations are contemplated to be within the scope of the present disclosure.

In accordance with an aspect of the present disclosure, the slider 200 is configured so that some degree of tilt does not lock the slider 200. Because plugs may have uneven contact prongs, a tilt tolerance or tilt threshold permits such plugs to be inserted into the disclosed electrical receptacle 100. When the slider 200 is tilted within the tilt tolerance or the tilt is below a predetermined tilt threshold, the slider 200 does not lock and is permitted to slide along the channel 334 of the platform and/or the channel 134 of the cover 110. Referring also to FIG. 7, the shutters 212 can be configured to have a shape or contour that implements the tilt tolerance or tilt threshold for multiple types of plugs.

Figure 11:
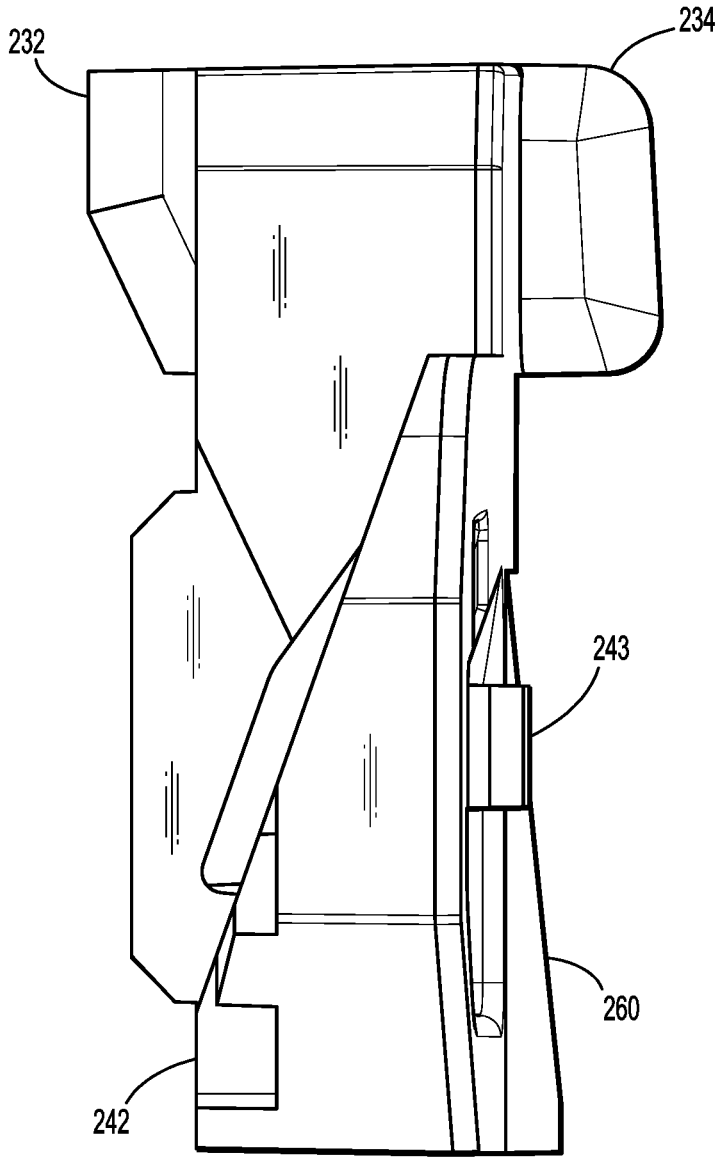
FIG. 11 is a diagram of a side view of the slider component, in accordance with aspects of the present disclosure.

FIG. 11 is a diagram of a side view of a slider, in accordance with aspects of the present disclosure. The side view illustrates the shapes of the posts 232, 234 for engaging the channels of the cover and/or platform, the shapes of the locking mechanisms 242, 243, and the profile of the back side 260 of the slider.

Figure 12:
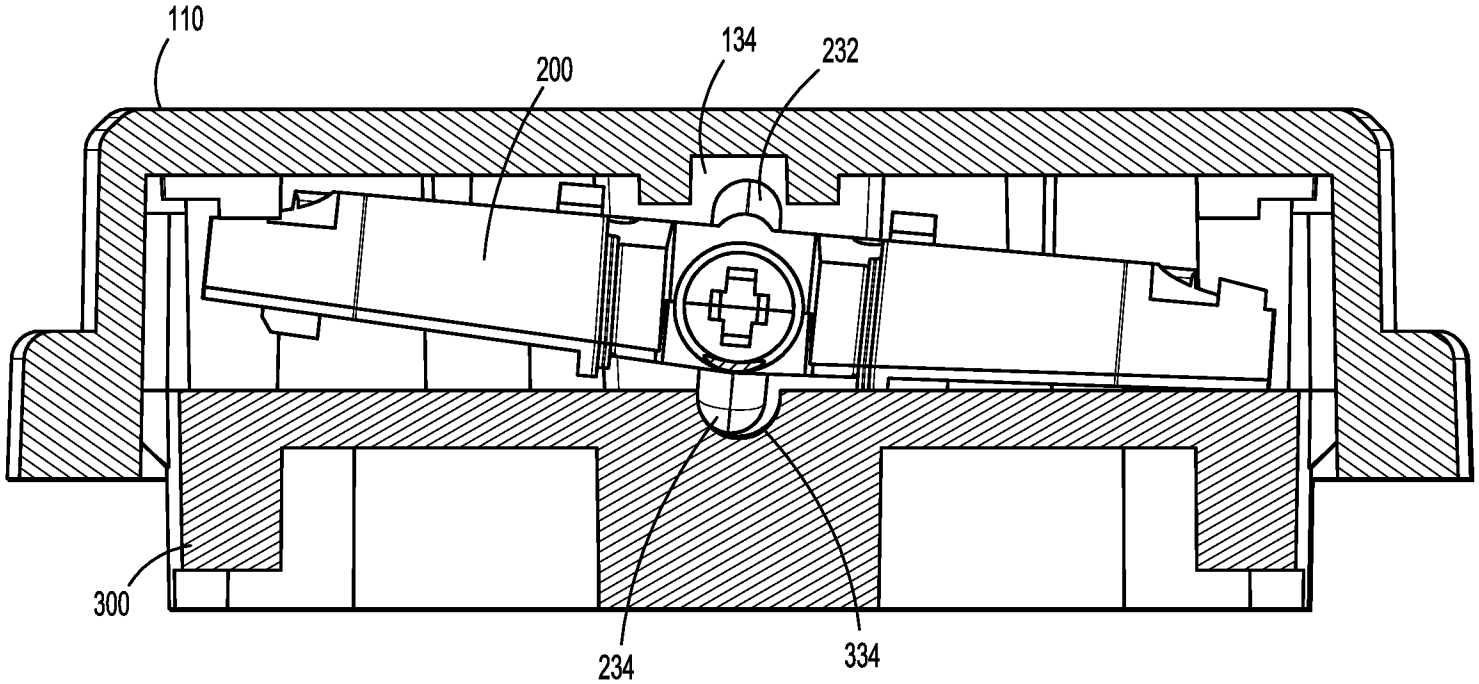
FIG. 12 is a diagram of a bottom view of the components of FIG. 2, in accordance with aspects of the present disclosure.

FIG. 12 is a diagram of a bottom view of the cover 110, slider 200, and platform 300 of FIG. 2. The front post 132 of the slider engages the channel 134 of the cover, and the back post 234 of the slider engages the channel 334 of the platform. FIG. 12 illustrates a full tilt of the slider 200 that causes a diagonal lock of the slider 200 against the cover 110 and the platform 300.

Figure 13:
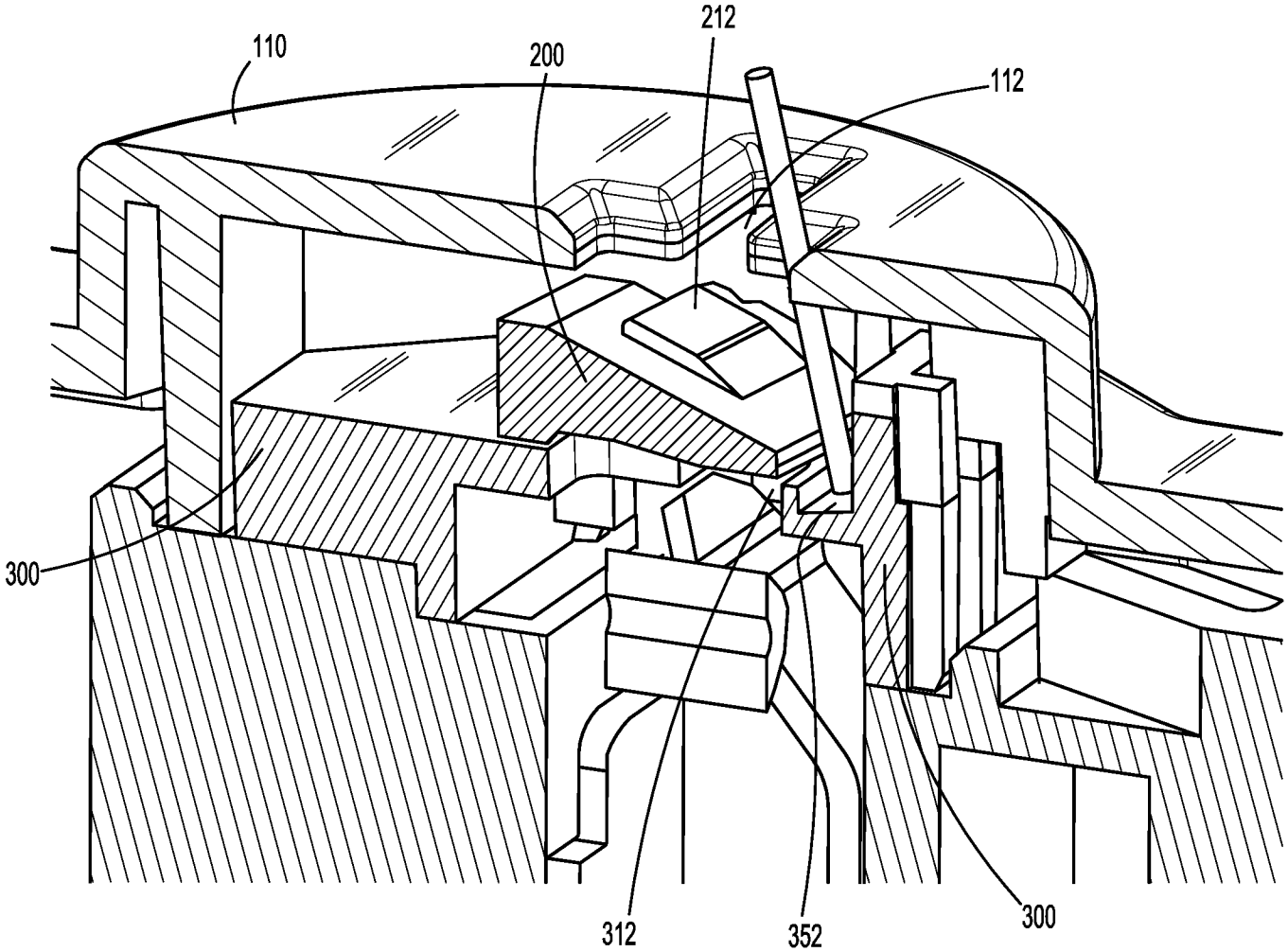
FIG. 13 is a diagram of a cross-sectional view of the electrical receptacle of FIG. 1, in accordance with aspects of the present disclosure.

FIG. 13 is a diagram of a cross-sectional view of the electrical receptacle of FIG. 1, including the cover 110, slider 200, and platform 300. A small implement is inserted into a cover aperture 112 and is sufficiently small to bypass the shutter 212 of the slider and to reach the platform 300.

In accordance with aspects of the present disclosure the platform includes a pin trap channel 352. The shutter 212 is sloped towards the pin trap channel 352 such the small implement is directed to and caught in the pin trap channel 352. The pin trap channel 352 is separate from the platform apertures 312 and prevents the implement from reaching the platform apertures 312. In this manner, the disclosed electrical receptacle 100 provides additional tamper resistance.

Accordingly, described above is a tamper resistant electrical receptacle that provides tamper resistance by diagonal locking and a pin trap channel. Because the shutter can be contoured or shaped to accommodate multiple types of plugs, the slider can remain unlocked when different types of plugs are inserted into the electrical receptacle. Accordingly, the disclosed electrical receptacle is able to accommodate multiple types of plugs and is applicable to different plug types in different regions of the world.

The embodiments disclosed herein are examples of the disclosure and may be embodied in various forms. For instance, although certain embodiments herein are described as separate embodiments, each of the embodiments herein may be combined with one or more of the other embodiments herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The phrases "in an embodiment," "in embodiments," "in various embodiments," "in some embodiments," or "in other embodiments" may each refer to one or more of the same or different embodiments in accordance with the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances. The embodiments described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. An electrical receptacle comprising:

a cover including two cover apertures configured to receive two contact blades of a plug;

a platform coupled to the cover, the platform including two platform apertures aligned with the two cover apertures, a channel between the two platform apertures, and a pin trap channel separate from the two platform apertures;

a slider positioned between the cover and the platform and coupled to the platform, the slider including a post engaging the channel and shutters connected to the post; and a coil spring coupled to the slider, the coil spring having a resting state in which the shutters are interposed between the two cover apertures and the two platform apertures, and having a compressed state in which the shutters are not interposed between the two cover apertures and the two platform apertures such that the two contact blades of the plug are permitted to pass through the two platform apertures, wherein the slider glides along the channel of the platform as the coil spring moves between the resting and compressed states, and wherein the pin trap channel is positioned to trap a pin that is inserted into one of the two cover apertures and that reaches the platform past the shutters.

2. The electrical receptacle of claim 1, wherein the two platform apertures are oriented horizontally relative to each other, and wherein the channel of the platform is oriented vertically such that the slider and the shutters glide vertically along the channel.

3. The electrical receptacle of claim 2, wherein the shutters are angled relative to the platform such that the shutters tilt horizontally about the post.

4. The electrical receptacle of claim 3, wherein the cover and the platform each includes a locking mechanism, wherein the shutters engage both locking mechanisms and are diagonally locked to the cover and the platform when the shutters are fully left-tilted and when the shutters are fully right-tilted.

5. The electrical receptacle of claim 3, wherein at least one of the cover or the platform includes a left-tilt locking mechanism and at least one of the cover or the platform includes a right-tilt locking mechanism, wherein the shutters engage the left-tilt locking mechanism when the shutters are fully left-tilted, and wherein the shutters engage the right-tilt locking mechanism when the shutters are fully right-tilted.

6. The electrical receptacle of claim 5, wherein the slider includes protrusions, and wherein the left-tilt locking mechanism and the right-tilt locking mechanisms are complementary protrusions configured to engage the protrusions of the slider.

7. The electrical receptacle of claim 5, wherein the shutters do not engage the left-tilt locking mechanism or the right-tilt locking mechanism when a tilt of the shutters is less than a predetermined tilt threshold.

8. The electrical receptacle of claim 7, wherein the shutters are contoured to maintain the tilt of the shutters at less than the predetermined tilt threshold for different orientations of the contact blades of the plug.

9. The electrical receptacle of claim 8, wherein the shutters are contoured to maintain the tilt of the shutters at less than the predetermined tilt threshold for at least two of: plug type A, plug type B, plug type C, plug type D, plug type E, plug type F, plug type G, plug type H, plug type I, plug type J, plug type K, plug type M, or plug type N.

10. The electrical receptacle of claim 1, wherein the shutters of the slider are sloped towards the pin trap.

11. The electrical receptacle of claim 1, wherein the shutters are sloped toward the platform in a direction of the coil spring extending from the compressed state to the resting state.

12. The electrical receptacle of claim 11, wherein forcing the contact blades of the plug against the shutters causes the slider to glide along the channel and compress the coil spring from the resting state to the compressed state.

13. The electrical receptacle of claim 1, wherein the cover further includes a second channel between the two cover receptacles and the slider further includes a second post configured to engage the second channel, wherein the second channel is parallel to the channel of the platform.

14. The electrical receptacle of claim 1, wherein the platform further includes a ledge, wherein the coil spring in the resting state biases the slider against the ledge.

* * * * *